United States Patent [19]

Nishio et al.

[11] 4,341,195

[45] Jul. 27, 1982

[54] IGNITION SYSTEM FOR SPARK PLUGS CAPABLE OF REMOVING CARBON DEPOSITS

[75] Inventors: Kanemitsu Nishio, Komaki; Takashi Suzuki, Nagoya, both of Japan

[73] Assignee: NGK Spark Plug Co., Ltd., Nagoya, Japan

[21] Appl. No.: 113,326

[22] Filed: Jan. 18, 1980

Related U.S. Application Data

[63] Continuation of Ser. No. 893,415, Apr. 4, 1978, abandoned.

[30] Foreign Application Priority Data

Apr. 6, 1977 [JP] Japan ..... 52-38504

[51] Int. Cl.[3] ..... F02P 1/00

[52] U.S. Cl. ..... 123/598; 123/606; 123/636; 315/209 CD

[58] Field of Search ..... 123/598, 606, 607, 613, 123/618, 596, 636, 637, 651, 146.5 A; 315/209 CD

[56] References Cited

U.S. PATENT DOCUMENTS

| | | | |
|---|---|---|---|
| 1,444,464 | 2/1923 | Hunt | 123/146.5 A |
| 2,474,550 | 6/1949 | Short et al. | 315/209 CD |
| 3,018,413 | 1/1962 | Neapolitakis | 123/607 |
| 3,263,124 | 7/1966 | Stuermer | 123/651 |
| 3,394,689 | 7/1968 | Bell | 315/209 R |
| 3,489,129 | 1/1970 | Issler et al. | 123/598 |
| 3,520,288 | 7/1970 | Dusenberry et al. | 315/209 R |
| 3,913,550 | 10/1975 | Canup | 123/606 |
| 4,033,316 | 7/1977 | Birchenough | 123/598 |
| 4,036,200 | 7/1977 | Kuehn | 123/598 |
| 4,133,329 | 1/1979 | Caron | 123/598 |

*Primary Examiner*—P. S. Lall

*Attorney, Agent, or Firm*—Stevens, Davis, Miller and Mosher

[57] ABSTRACT

An ignition system for creeping discharge spark plugs for producing a spark discharge at least one portion of which slidably moves along a creeping discharge path is disclosed. The system comprises producing a spark discharge operative to ignite a mixed gas in an usual manner and selectively producing a purifying and sweeping spark discharge operative to remove carbon deposited on said creeping discharge path. An ignition circuit for carrying out the system is also disclosed.

3 Claims, 11 Drawing Figures

(Multiple Spark Wave Form)

(Single Spark Wave Form)

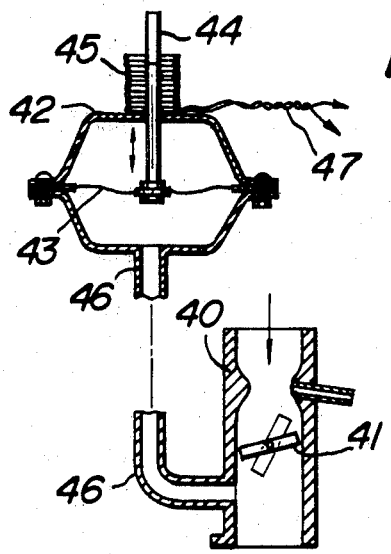
FIG. 8A
FIG. 8B
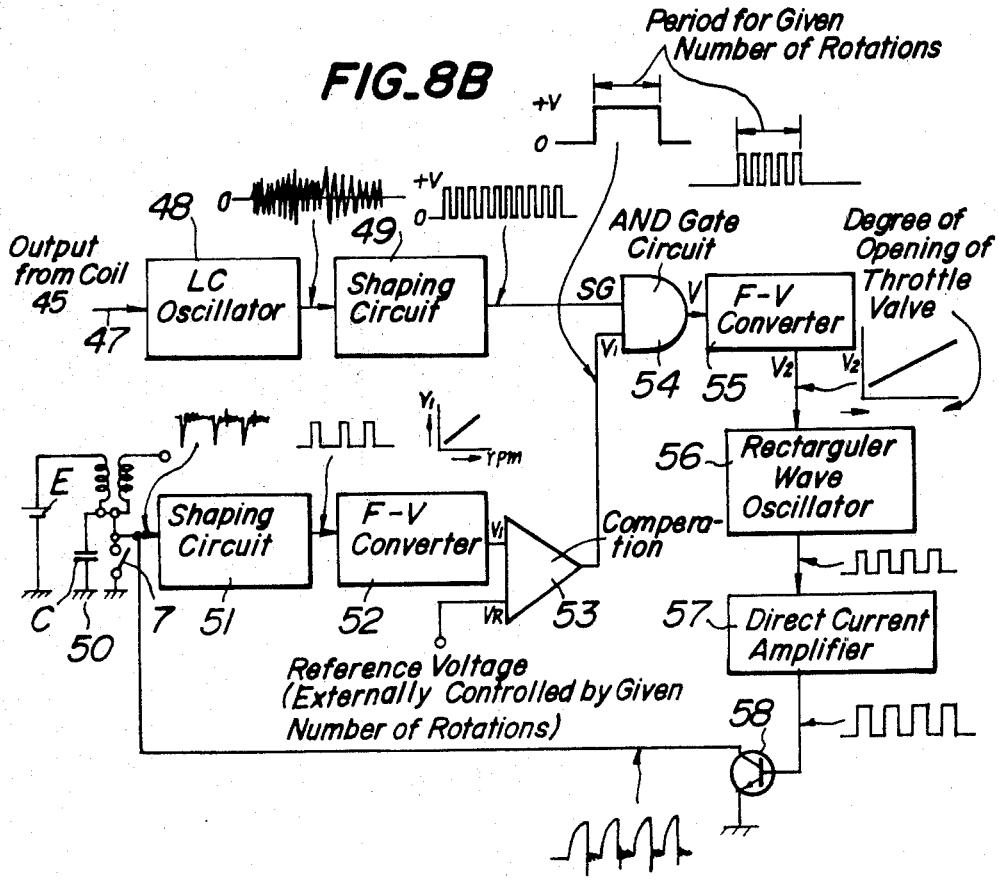

IGNITION SYSTEM FOR SPARK PLUGS CAPABLE OF REMOVING CARBON DEPOSITS

This is a continuation of application Ser. No. 893,415 filed Apr. 4, 1978, now abandoned.

BACKGROUND OF THE INVENTION

1. Field of the Invention

This invention relates to ignition systems for creeping spark plugs and more particularly to an ignition system for a semi-creeping spark plug or a full-creeping spark plug for producing a spark discharge at least one portion of which slidably moves along a creeping discharge path.

2. Description of the Prior Art

In the above mentioned kind of spark plugs, carbon is often deposited on the creeping discharge path depending on operating conditions of an engine which makes use of the spark plug.

In order to remove such deposited carbon, heretofore it has been the common practice to utilize a spark energy of the spark discharge produced along the creeping discharge path when a mixed gas is ignited so as to scatter or burn the deposited carbon. Such conventional carbon removing system is generally called as an electrical self-purifying system.

Experimental tests on such electrical self-purifying system have yielded the result that the carbon is mainly removed by a capacitive discharge energy produced at the beginning of the spark discharge, and that an inductive discharge energy immediately followed by the capacitive discharge energy becomes jumped up from the creeping discharge path, thereby exhibiting no effect of removing the carbon deposited on the creeping discharge path.

The simplest and most effective way of increasing the capacitive discharge energy is to repeat the spark discharge for a number of times.

Further experimental tests have demonstrated the result that the amount of carbon to be deposited on the creeping discharge path becomes significantly changed in dependence with the operating condition of an engine, and that even though the electrical self-purifying system is improved, such improvement is not sufficient to provide an ignition system which can effectively prevent the creeping discharge path of the spark plug from being deposited with carbon irrespective of all of the operating conditions of the engine.

SUMMARY OF THE INVENTION

An object of the invention, therefore, is to provide an ignition system for a semi- or full-creeping spark plug, which can eliminate the above mentioned drawbacks which have been encountered with the prior art techniques.

A feature of the invention is the provision of an ignition system for spark plugs for producing a spark discharge at least one portion of which slidably moves along a creeping discharge path, characterized by comprising producing a spark discharge operative to ignite a mixed gas, and producing separately a purifying and sweeping spark discharge operative to remove carbon deposited on the creeping discharge path.

Other features, objects and advantages of the present invention will become apparent upon a perusal of the following specification taken in connection with the accompanying drawings, wherein:

BRIEF DESCRIPTION OF THE DRAWINGS

FIG. 8A is a schematic longitudinal sectional view of a detector for detecting a degree of opening of a throttle valve that may be employed to practice the present invention; and FIG. 8B is a block diagram of an embodiment of an ignition system according to the invention.

DETAILED DESCRIPTION OF THE PREFERRED EMBODIMENTS

The invention aims at a complete research of an engine operation range that is liable to easily deposit carbon on a creeping discharge path of a semi- or full-creeping spark plug for the purpose of effectively realizing an electrical forced purifying and sweeping action which can effectively eliminate carbon deposited on the creeping discharge path.

The reasons why the separate capacitive spark discharge added to the ignition spark discharge can effectively remove carbon deposited on the creeping discharge path even under such operating condition of the engine that as much amount of carbon is produced and carbon deposited on the creeping discharge path could not be removed by an ignition spark discharge energy or by increased energy thereof will now be described.

In the first place, the effect of the separate capacitive spark discharge energy added to the ignition spark discharge energy is ascertained by the following measuring test.

In the present measuring test, use was made of a 2 cycle engine provided with 2 water-cooled cylinders and having a capacity of 360 cc. The engine was operated under the following conditions.

Number of rotations: 800 r.p.m.

Water temperature: 80° C.

Oil temperature: 56° C.

Figure 1:
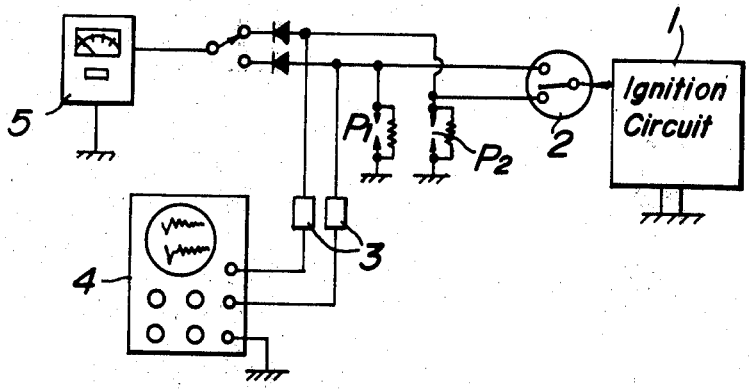
FIG. 1 is a simplified illustration of a testing circuit that may be employed to measure a time at which a spark plug is ignited and an insulating resistance of a creeping discharge path during an idling operation of an engine.

Use was made of semi-creeping spark plug as an ignition plug and a testing circuit shown in FIG. 1 and for measuring the ignition time and insulating resistance of the creeping discharge path. Then, an idling operation of the engine was continued and the time of igniting the spark plug was measured. During the operation, the insulating resistance of the spark plug every 5 minutes was also measured.

Referring to FIG. 1, reference numeral 1 designates an ignition circuit, 2 a distributor, $P_1$, $P_2$ semi-creeping discharge plugs, 3 a high voltage probe, 4 an oscilloscope and 5 a 1,000 V megger.

Figure 2:
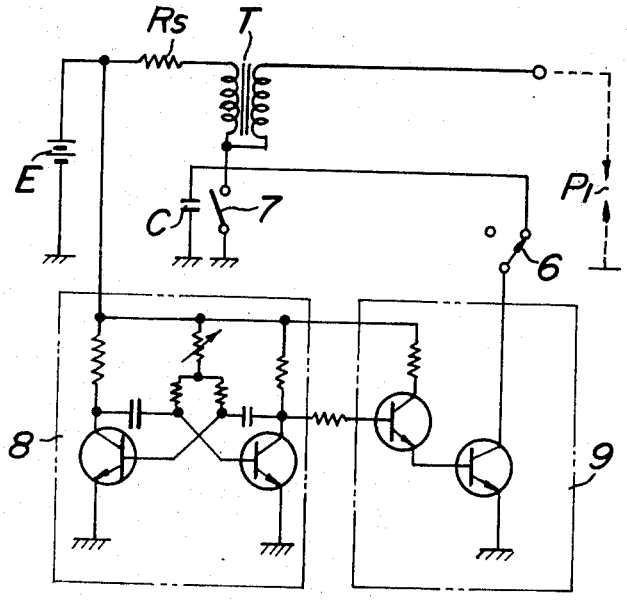
FIG. 2 is an ignition electrical source that may be used for the testing circuit shown in FIG. 1.

FIG. 2 shows an ignition electric source used for the testing circuit 1 shown in FIG. 1.

Figure 3:
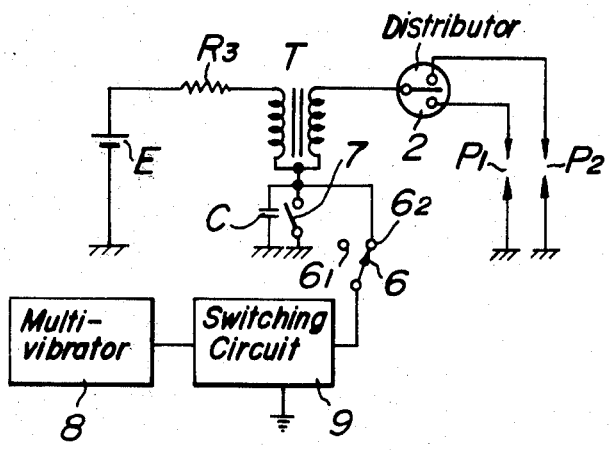
FIG. 3 is a simplified illustration of a testing ignition circuit.

FIG. 3 shows a combination of the ignition electric source shown in FIG. 2 and the distributor 2 and spark plugs $P_1$, $P_2$ shown in FIG. 1.

Figure 4:
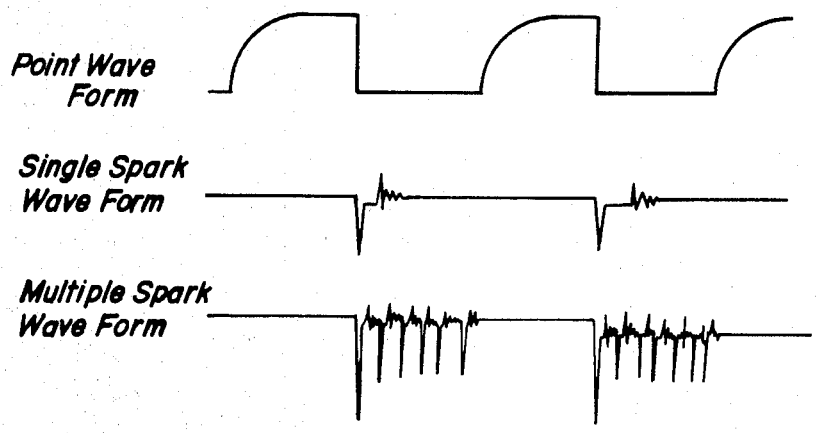
FIG. 4 is a wave form diagrams illustrating a point wave form, single spark wave form and multiple spark wave form, respectively.

FIG. 4 shows voltage wave forms illustrating timing relation between a single spark wave form and a multiple spark wave form.

In the testing circuit shown in FIG. 3, if a change-over switch 6 is closed to a contact $6_1$ and a switch 7 is closed, the single spark voltage having the wave form shown in FIG. 4 is applied through the distributor 2 to the spark plug $P_1$ or $P_2$. If the change-over switch 6 is closed to a contact $6_2$ and the switch 7 is made open, the multiple spark voltage having the wave form shown in FIG. 4 is applied through a pulse transformer T and the distributor 2 to the spark plug $P_1$ or $P_2$. In FIGS. 2 and 3, reference numeral 8 designates a multivibrator and 9 a switching circuit.

Figure 5:
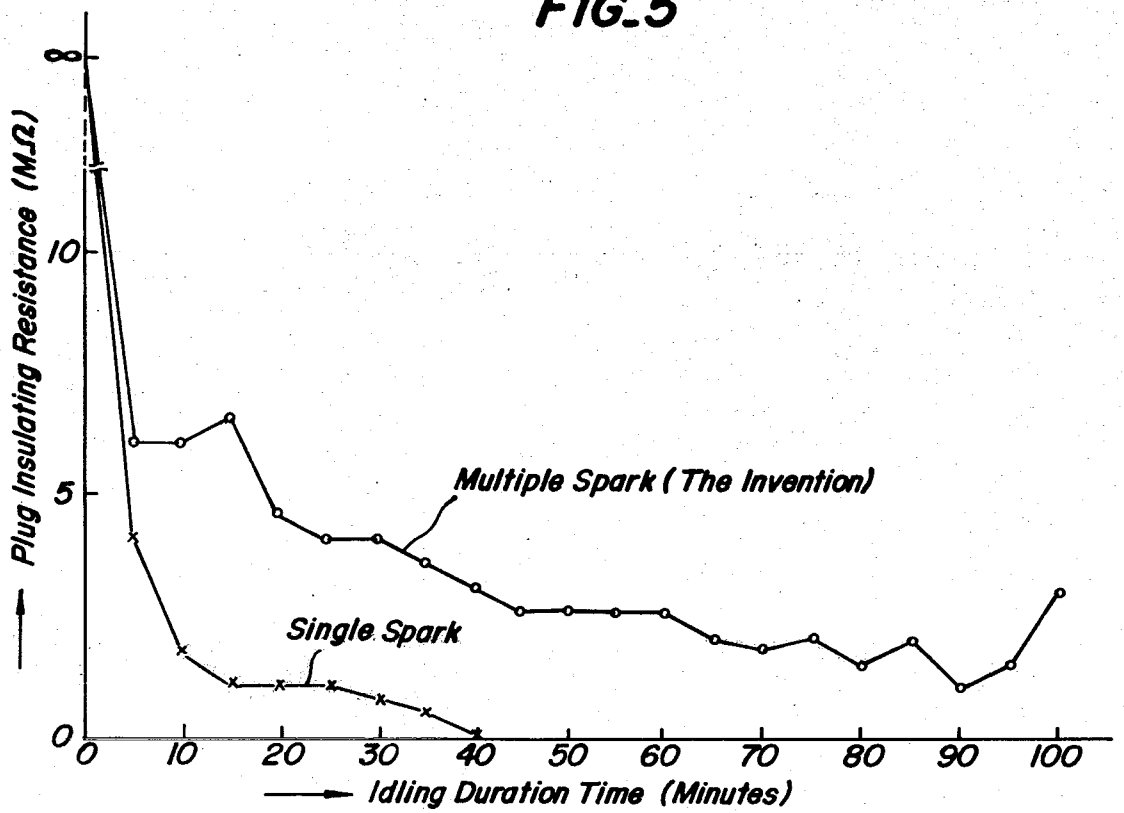
FIG. 5 is a graph which illustrates a decrease of an insulating resistance of a creeping discharge path as a function of an idling duration time with respect to a multiple spark according to the invention as compared with a conventional single spark.

FIG. 5 shows a curve illustrating the relation between the idling duration time and the plug insulating resistance when the single spark is produced along the creeping discharge path as compared with a curve illustrating the corresponding relation when the multiple spark is produced along the creeping discharge path according to the invention. As seen from FIG. 5, the use of measures of producing the multiple spark along the creeping discharge path according to the invention ensures an efficient removal of carbon deposited on the creeping discharge path.

Experimental tests on a lamellar combustion type engine have shown the following result.

Figure 6:
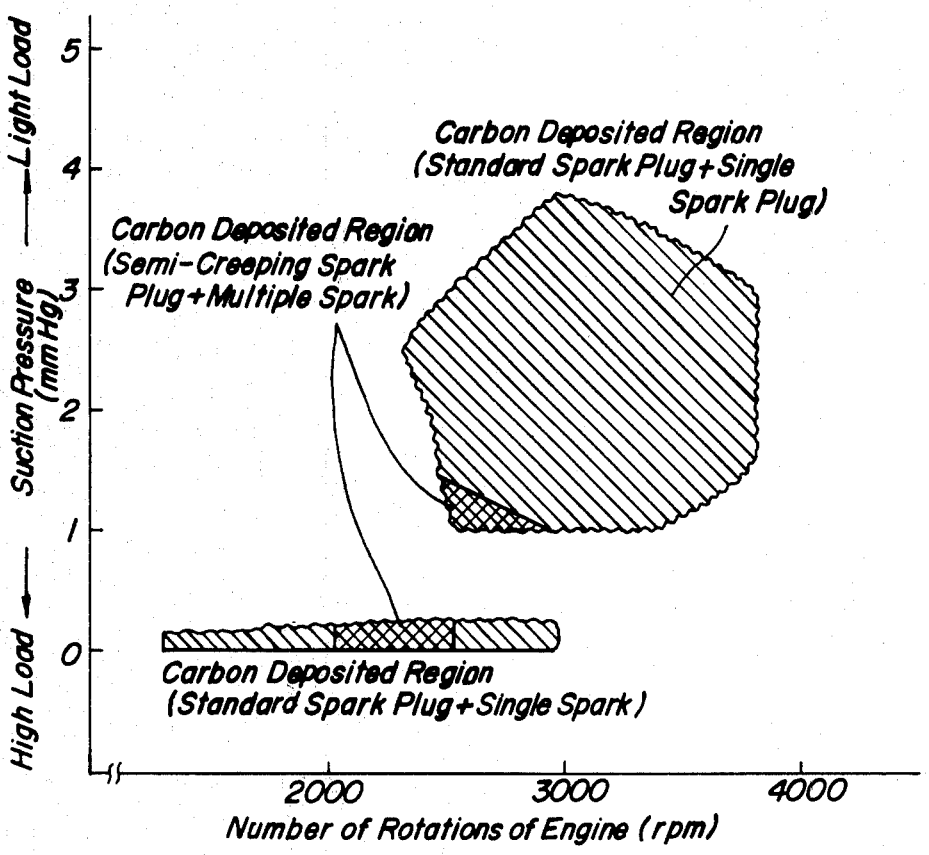
FIG. 6 is a graph which illustrates carbon deposited regions produced under different suction pressures as a function of the number of rotations of an engine.

FIG. 6 shows an operation condition under which occurs misfiring due to carbon deposited when use is made of a combination of a standard spark plug and a single spark.

The misfiring occurs at two regions shown by hatched lines, that is, a low speed region when a throttle valve is fully opened and a relatively high speed region under a partial load. Particularly, carbon tends to be most frequently deposited at the low speed region when the throttle valve is fully opened.

As seen from FIG. 6, it is recognized that the carbon tends to be easily deposited in dependence with the operating condition of the engine. But, such tendency is influenced by the amount of carbon deposited. The carbon is adhered to the insulating body of the spark plug to degrade the insulating performance of the spark plug. As a result, if provision is made of means for removing carbon under such operating condition that much amount of carbon is deposited and the carbon thus deposited is easily adhered to the insulating surface of the spark plug, it is possible to remove the carbon thus deposited.

In FIG. 6, cross-hatched regions illustrate an effect attained by a combination of the multiple spark and the use of a semi-creeping plug. As seen from FIG. 6, the use of such combination of the multiple spark and the use of semi-creeping spark plug ensures a significant reduction of the carbon-deposited region.

During the experimental test, use was made of the single spark electric source instead of the multiple spark electric source at regions where the carbon deposited region is not present under the operating condition of the engine. Such region is not deposited with carbon from the outset, and as a result, there revealed no change at the region.

The above mentioned experimental tests have demonstrated the result that the use of measures of effecting multiple spark discharge for the purpose of forcedly removing carbon under such operating condition that a large amount of carbon is produced and that the carbon is liable to be easily deposited on the creeping discharge path of the semi-creeping spark plug and of effecting a single spark discharge for the purpose of igniting the spark gap under such operating condition that a lesser amount of carbon is produced and the carbon is not liable to be easily deposited on the creeping discharge path of the spark plug providing an ignition system which can be operative to prevent the creeping discharge path of the semi- or full-creeping spark plug from being deposited with carbon.

The multiple spark energy reveals the following effect. Experimental tests were effected for the purpose of ascertaining the influence of the single spark and the multiple spark to be exerted to the insulating resistance of a spark plug mounted on a light automobile provided with a 2 cycle engine and running on a test source whose one round is about 5 km.

Figure 7A:
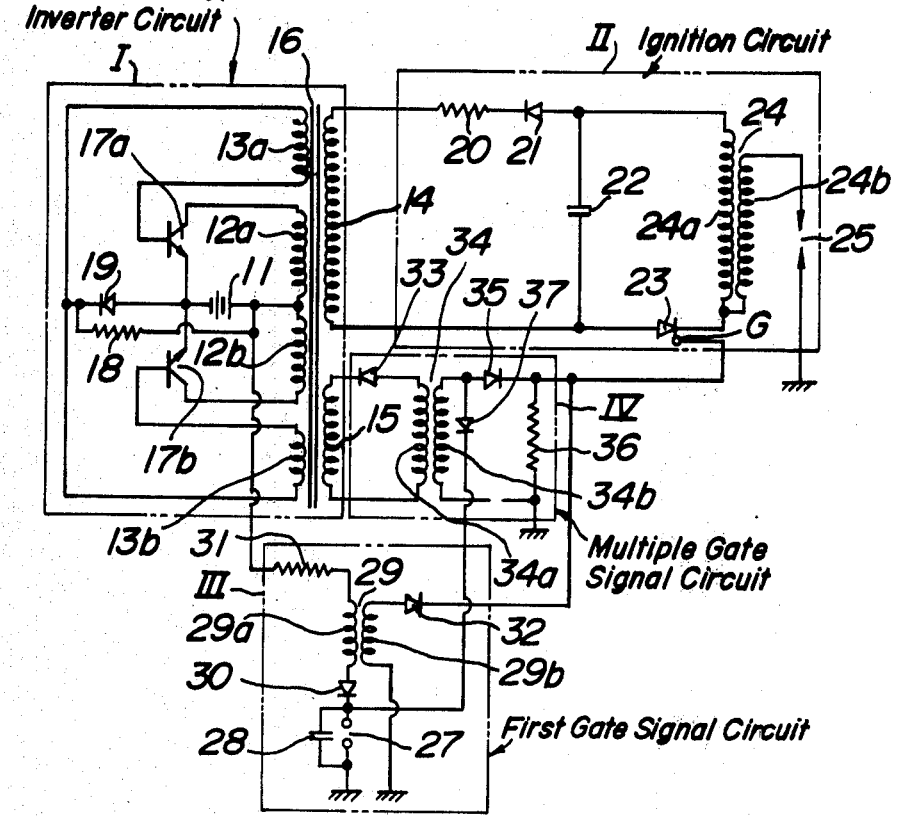
FIG. 7A is an illustration of an electrical circuit that may be employed as a multiple spark electric source according to the invention.

FIG. 7A shows an ignition circuit which constitutes a multiple spark electric source that may be used to practice the invention.

In FIG. 7A, reference numeral I designates a well known multivibrator type inverter circuit for stepping up a low direct current voltage to a high alternating current voltage. In this inverter circuit I, reference numeral 11 designates a direct current low voltage source (12 V or 24 V accumulator mounted on the light automobile), 12*a*, 12*b* input coils, 13*a*, 13*b* auxiliary input coils, 14 an output coil, 15 a multiple gate signal output coil, and 16 a saturable transformer composed of the input coils 12*a*, 12*b*, 13*a*, 13*b* and the output coils 14, 15. Reference numeral 17*a*, 17*b* designate a pair of NPN type transistors having emitters connected to the negative terminal of the direct current low voltage source 11, collectors connected to the input coils 12*a*, 12*b*, respectively, and bases connected to the auxiliary input coils 13*a*, 13*b*, respectively, 18 a base resistor of the transistors 17*a*, 17*b* and 19 a rectifier. In FIG. 7A, reference numeral II designates a well known condenser discharge ignition circuit in which reference numeral 20 designates a charging resistor connected in series with a charging rectifier 21 to the output coil 14, 22 a charging condenser, 23 a silicon controlled rectifier (SCR) for discharging the electric charge accumulated in the condenser 22, and 24 an ignition coil composed of a primary coil 24*a* and a secondary coil 24*b* connected to a spark plug 25.

In FIG. 7A, reference numeral III designates a first gate signal circuit for producing a first spark at the ignition period of an engine, in which reference numeral 27 designates an interrupter for producing a spark discharge at the ignition period, 28 a condenser connected in parallel with the interrupter 27, 29*a* a primary coil connected in series through a rectifier 30 with the interrupter 27 and operative with a secondary coil 29*b* to constitute a pulse transformer 29, 31 a series resistor for controlling a current entering into the pulse transformer 29 and 32 a rectifier.

In FIG. 7A, reference numeral IV designates a multiple gate signal circuit for producing a successive spark for a plurality of times in continuation with the first spark when the interrupter 27 is open, in which reference numeral 33 designates a rectifier connected in series between the multiple gate signal coil 15 and a primary coil 34*a* of a pulse transformer 34 whose secondary coil 34*b* is connected through a rectifier 35 to a gate terminal G of the SCR 23 of the ignition circuit II, and 36 a SCR signal resistor which also serves as a gate of the first gate signal circuit III. A rectifier 37 at the side of the secondary coil 34*b* of the pulse transformer 34 is connected in series with the interrupter 27 so as to shortcircuit the SCR signal resistor 36 when the interrupter 27 is closed.

In the output coil 14 of the multivibrator type inverter circuit I (hereinafter will be called as I circuit) is produced an alternating current output which is rectangular wave form functions through the rectifier 21 of the ignition circuit II (hereinafter will be called as II circuit) to charge the condenser 22.

The time at which the condenser 22 has been charged is defined as an ignition period. At the ignition period, the interrupter 27 of the first gate signal circuit III (hereinafter will be called as III circuit) becomes opened to interrupt the ground connection. As a result, the pulse transformer 29 is energized from the electric source 11 to cause the secondary coil 29*b* to produce a pulse which constitutes an ignition signal and is supplied through the rectifier 32 to the gate terminal G of the SCR 23. Thus, the SCR 23 becomes conductive to deliver the electric charge accumulated in the condenser 22 through the SCR 23 to the primary coil 24*a* of the ignition coil 24 whose secondary coil 24*b* becomes operative to apply a high voltage to the spark plug 25, thereby producing the first spark discharge.

In the multiple gate signal circuit IV (hereinafter will be called as IV circuit), the multiple gate signal coil 15 of the multivibrator type inverter 16 of the I circuit produces therein a signal voltage having the same wave form as that of the voltage produced in the output coil 14. This signal voltage is applied in the form of a pulse signal through the rectifier 33, secondary coil 34*b* of the pulse transformer 34 to the gate terminal G of the SCR 23 when the interrupter 27 of the III circuit is open so as to interrupt the ground connection. The spark discharge energy of this pulse signal is different from that spark discharge energy which is obtained when all of the electric charge of the condenser 22 of the II circuit, which has been charged during closing of the interrupter 27, is delivered by the first spark discharge caused by the pulse signal from the pulse transformer 29 of the III circuit. That is, the above mentioned spark discharge energy of the pulse signal is obtained after that amount of electric charge has been accumulated which is sufficient to substantially induce the spark discharge when the interrupter 27 is open and hence becomes a multiple spark discharge whose energy is somewhat smaller than that of the first spark discharge. The pulse transformer 34 of the IV circuit is provided for the purpose of delivering the wave form of that voltage which is induced in the multiple gate signal coil 15 to the gate terminal G of the SCR 23. Alternatively, the pulse transformer 34 may be omitted and the voltage induced in the multiple gate signal coil 15 and having the rectangular wave may directly be applied to the gate terminal G of the SCR 23.

Figure 7B:
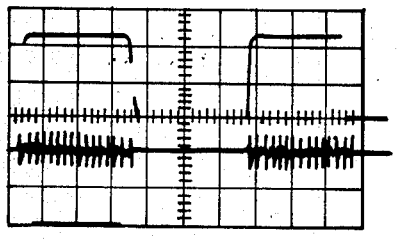
FIG. 7B is a graph which illustrates a multiple spark wave form.
Figure 7C:
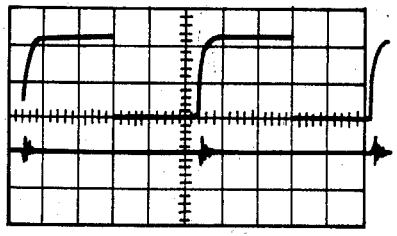
FIG. 7C is a graph which illustrates a single spark wave form.

FIG. 7B shows one example of the wave form of the multiple spark discharge voltage obtained as described above. FIG. 7C shows a conventional single spark discharge voltage wave form.

In the following experimental tests, the insulating resistance of the full creeping spark plug was measured every one round when the automobile ran on the test course. The insulating resistance due to the conventional single spark became lowered to 0.2 to 0.3 MΩ after the one round running, while the insulating resistance due to the multiple spark became lowered to 5 to 10 MΩ after the one round running. The insulating resistance due to the conventional single spark became lowered to 0.2 to 0.3 MΩ after three round runnings, while the insulating resistance due to the multiple spark became lowered to 3 to 4 MΩ. The insulating resistance due to the conventional single spark became lowered to 0.1 to 0.2 MΩ after five round runnings, while the insulating resistance due to the multiple spark became lowered to 2 to 5 MΩ. In addition, the measuring tests on the creeping discharge path of the spark plug have yielded the result that in the multiple spark the amount of carbon deposited on the creeping discharge path is extremely small and its insulating resistance is not so much lowered and hence there is no risk of misfiring being induced.

As seen from the above, the multiple spark electric source is remarkably different from the single spark electric source. In order to remove the carbon deposited on the creeping discharge path of the creeping spark plug, it is ascertained again that firing along the creeping discharge path with the object other than the ignition can prevent the decrease of the insulating resistance.

In addition, the multiple spark discharge for removing the deposited carbon sometimes may be effected without producing the spark discharge in dependence with the voltage value used when the insulating resistance of the creeping discharge path becomes remarkably decreased.

That is, it is recognized that a high voltage which is not so high as to produce the spark discharge is effective to remove the deposited carbon. It is a matter of course that the spark discharge produced along the creeping discharge path by means of the purifying and sweeping high voltage is far superior in the effect of removing the deposited carbon.

The above described experimental tests have demonstrated the result that if the single spark and the multiple spark are controlled in match with the operating condition of the engine, the ignition system which cannot be deposited with carbon can be operated with a high efficiency.

FIGS. 8A and 8B show an embodiment of a multiple spark adding electric source for carrying out an ignition system according to the invention.

FIG. 8A shows essential parts of a detector 42 for detecting a degree of opening of a throttle valve 41. Larger or smaller degree of opening of the throttle valve 41 provided in a carburetor 40 causes a diaphragm 43 provided in the detector 42 to bend with the aid of a negative suction pressure subjected thereto. As a result, a dust core 44 secured at its lower end to the center part of the diaghragm 43 is raised and lowered through a coil 45 in directions shown by arrows and hence it is possible to utilize change of the output inductance L of the coil 45. In this case, the detector 42 is arranged such that the output inductance L of the coil 45 becomes minimum when the throttle valve 41 is fully closed and becomes maximum when the throttle valve 41 is fully opened. As a result, it is possible to detect the degree of opening of the throttle valve 41 in dependence with the inductance value L of the coil 45. In FIG. 8A, reference numeral 46 designates a suction pipe and 47 an output lead wire of the output inductance L of the coil 45. The dust core 44 is composed of a magnetic bar formed, for example, of ferrite and connected through a non-magnetic bar formed, for example, of plastics to the diaphragm 43.

FIG. 8B shows an electrical circuit of a multiple spark generation device for carrying out the ignition system according to the invention, which is operative to be controlled by the above mentioned output from the coil 45 shown in FIG. 8A. In FIG. 8B, reference numeral 48 designates a LC oscillator composed of the inductance coil 45 of the detector 42 and a condenser. The LC oscillator 48 functions to deliver a variable oscillation frequency pulse depending on the L value of the coil 45. The pulse is converted into a pulse having a constant amplitude by means of a shaping circuit 49.

An ignition circuit 50 functions to deliver an oscillation signal which is supplied through a shaping circuit 51 in a F-V converter 52 which serves to convert the pulse signal into a voltage $V_1$ which changes as a function of the revolutional speed of the engine. This voltage $V_1$ is compared at a comparator 53 with a reference voltage $V_R$ corresponding to a given revolutional speed, for example, 2,000 r.p.m. of the engine. When the voltage $V_1$ is lower than the reference voltage $V_R$, that is, when the revolutional speed corresponding to the voltage $V_1$ is smaller than 2,000 r.p.m., a signal voltage $V_1$ is generated so as to provide a multiple spark gate.

A throttle opening degree signal SG and the signal voltage $V_1$ are supplied to an AND gate circuit 54 which then functions to produce a throttle signal V only when the revolutional speed of SG is smaller than the given revolutional speed indicated by $V_1$.

The throttle signal V is supplied to a F-V converter 55 which functions to convert the throttle signal V into a voltage $V_2$ which changes as a function of the degree of opening of the throttle valve 41. The higher the frequency F, that is, the larger the throttle opening degree, the higher the output voltage $V_2$.

In FIG. 8B, reference numeral 56 designates a rectangular wave oscillator, i.e. voltage controlled oscillator (VCO) the oscillation output of which is supplied through a direct current amplifier 57 to a switching power transistor 58 which constitutes a multiple spark ignition electric source whose frequency, that is, the number of sparks is determined by $V_2$. The number of sparks becomes the largest when the throttle valve 41 is fully opened ($V_2$ is maximum). When the throttle valve 41 is somewhat closed, the oscillation of the rectangular wave oscillator 56 becomes stopped to produce the conventional single spark.

For example, when the throttle valve 41 is fully opened with the number of rotations of the engine which is smaller than 2,000 r.p.m., the number of sparks becomes on the order of 20 times. When the throttle valve 41 is closed, the number of sparks is decreased up to several times until finally becomes zero. Even when the throttle valve 41 is opened, if the number of rotations of the engine is larger than 2,000 r.p.m., the multiple spark electric source is not operated, thereby producing the conventional single spark.

As described above, the multiple spark adding electric source shown in FIGS. 8A and 8B is operative in response to the two conditions, that is, the degree of opening of the throttle valve 41 and the revolutional speed of the engine.

As stated hereinbefore, the invention is capable of effectively removing carbon deposited on the creeping discharge path of the creeping discharge spark plug.

What is claimed is:

1. An ignition circuit for spark plugs capable of removing carbon deposits, comprising a multivibrator type inverter circuit connected to a low direct current source and producing a high alternating current voltage; an ignition circuit including a condenser operative to be charged by said high alternating current voltage, a silicon controlled rectifier having a gate terminal and a creeping discharge spark plug; a first gate signal circuit connected between said multivibrator type inverter circuit and said gate terminal of the silicon controlled rectifier and including an interrupter operatively connected with an engine, said first gate signal circuit being operative to make conductive said silicon controlled rectifier in response to the operation of said interrupter and produce a single spark; and a multiple gate signal circuit connected between said multivibrator type inverter circuit and said first gate signal circuit, said multiple gate signal circuit being connected to said gate terminal of the silicon controlled rectifier and operative to make conductive said silicon controlled rectifier in response to the operation of said interrupter and produce a multiple spark.

2. The ignition circuit according to claim 1 wherein said multiple gate signal circuit comprises an LC oscillator connected to an inductance coil whose inductance value is changed in response to the degree of opening of a throttle valve provided in a carburetor of an engine and a F-V converter connected to said first gate signal circuit, further comprising comparison means for comparing the output of said multiple gate signal circuit said F-V converter with a reference voltage externally controlled in accordance with a given rotational speed of the engine and gate means for gating the outputs of said comparison means and said LC oscillator, thereby making conductive said silicon controlled rectifier in response to the degree of opening of said throttle valve and to the operation of said interrupter and producing a multiple spark.

3. An ignition system for producing first spark discharges for ignition purposes and second spark discharges for removing carbon deposits on the spark plugs of an internal combustion engine, comprising:

a multivibrator type inverter circuit adapted to be connected to a low direct current source and producing a high alternating current voltage;

an ignition circuit connected to said multivibrator type circuit comprising a capacitor having first and second terminals operatively connected to said multivibrator type inverter circuit and operating to be charged by the high alternating current voltage, an ignition coil operatively connected to said first terminal of said capacitor, a creeping discharge spark plug, and a silicon controlled rectifier having an input connected to said second terminal of said capacitor and an output connected to said ignition coil, said silicon rectifier having a gate such that when a sufficient gating signal is received at said gate the charge in said capacitor discharges across said ignition coil and causes said spark plug to discharge;

a first gate signal circuit having an input connected to said multivibrator type inverter circuit and an output connected to said gate and comprising an interrupter operatively connected with an engine and a pulse transformer, said pulse transformer operating to produce a pulse signal to said gate to make conductive said silicon controlled rectifier when said interrupter is opened during the rotation of an engine whereby a first spark discharge is produced for causing combustion in an internal combustion engine;

a multiple gate signal circuit having an input connected to said multivibrator type inverter circuit and an output connected to said gate, said multiple gate signal circuit being operatively connected to said interrupter through a rectifier so as to short circuit said gate when said interrupter is closed, said multiple gate signal circuit being operative to make conductive said silicon rectifier in response to the operation of said interrupter and produce second spark discharges on said spark plug for removing carbon deposits;

whereby said first gate signal circuit operates to cause a first spark discharge to be produced by said spark plug for ignition purposes and said multiple gate signal circuit operates to cause second, multiple spark discharges to be produced by said spark plug for removing carbon deposits.

* * * * *